US006540567B1

(12) United States Patent
Yeh

(10) Patent No.: US 6,540,567 B1
(45) Date of Patent: Apr. 1, 2003

(54) BATTERY CONNECTOR ASSEMBLY

(75) Inventor: Ryan Yeh, Chino Hills, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/037,350

(22) Filed: Dec. 29, 2001

(51) Int. Cl.[7] ..... H01R 13/405
(52) U.S. Cl. ..... 439/736; 439/701
(58) Field of Search ..... 439/736, 701, 439/660

(56) References Cited

U.S. PATENT DOCUMENTS 5,108,317 A * 4/1992 Beinhaur et al. ..... 439/736
6,019,644 A * 2/2000 Kurbikoff et al. ..... 439/736
6,027,381 A * 2/2000 Lok ..... 439/736
6,102,748 A * 8/2000 Lee et al. ..... 439/736
6,368,158 B1 * 4/2002 Kan ..... 439/736
6,371,817 B1 * 4/2002 Shi et al. ..... 439/736

* cited by examiner

*Primary Examiner*—Gary Paumen
(74) *Attorney, Agent, or Firm*—Wei Te Chung

(57) ABSTRACT

A battery connector assembly (5, 5*a*) has an insulative housing (1, 1*a*) and a plurality of terminals (2, 2*a*). The housing has three passageways (101, 102, 103) defined by sidewalls (11, 12) and inner walls (13, 14). Each inner wall has a clasp (141). The terminals are inserted molded with an elongate insulative insert part (20, 20*a*). Latches (201, 203) are formed on the insert part. Each terminal has a connection portion (22, 22*a*) and a contacting portion (23, 23*a*). Pitches between terminals are equal.

1 Claim, 6 Drawing Sheets

BATTERY CONNECTOR ASSEMBLY

FIELD OF THE INVENTION

The present invention generally relates to a battery connector assembly, and more particularly to a battery connector assembly with easy and stable positioning of terminals to a housing thereof.

BACKGROUND OF THE INVENTION

It is well known that mobile phones or other portable electronic appliances often use rechargeable batteries as power sources. A conventional battery connector has a housing and a plurality of terminals received in passageways of the housing. Each passageway has two sidewalls. The terminals are fastened to a printed circuit board (PCB) by tabulate locking tabs, and the locking tabs abut against the sidewalls of the passageways, thus the terminals are retained in the housing. Each terminal has a resilient contacting region to contact with a contacting face of the battery.

However, as the locking tabs of the prior art only prevent the relative movement between the housing and the terminals in downward direction, the terminals could not be retained securely in the housing by locking tabs, so that a reliable connection could not be formed between the terminals and corresponding contacts of the mobile phones.

Hence, an improved battery connector assembly with improved terminals is needed to overcome the forgoing shortcomings.

BRIEF SUMMARY OF THE INVENTION

A main object of the present invention is to provide a battery connector assembly, wherein terminals of the battery connector assembly could be secured in a housing stably.

A battery connector assembly according to the present invention includes an insulative housing and a plurality of terminals. The housing has a first and second sidewalls, a first and second inner walls and three passageways defined by the sidewalls and inner walls. A clasp is formed on each of the inner walls. The terminals are inserted molded with an insulative insert part, wherein each pitch between every two terminals is equal. Each of the terminals has a connection portion and a contacting portion with a convexity located on the contacting portion. The insert part has two latches, and each latch has a barb. The barbs are located face-to-face.

In assembly, the terminals are received in the passageways of the housing with the contacting portion projecting beyond the housing. The latches of the insert part abut against the inner walls with barbs engaging with the clasps of the inner walls.

Other objects, advantages and novel features of the invention will become more apparent from the following detailed description of a preferred embodiment when taken in conjunction with the accompanying drawings.

DETAILED DESCRIPTION OF THE INVENTION

Figure 1:
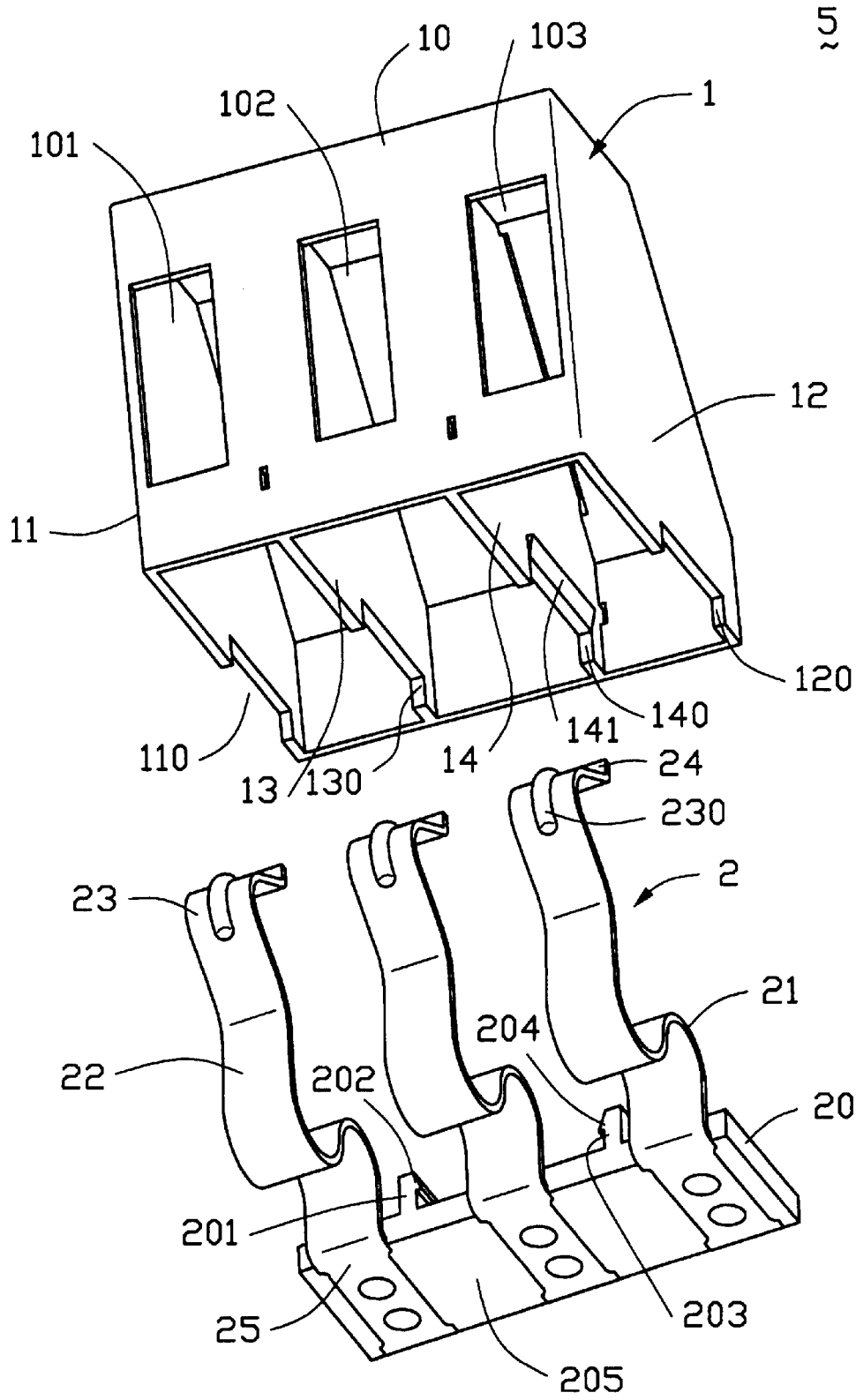
FIG. 1 is an exploded view of a battery connector assembly according to one embodiment of the present invention.

Referring to FIG. 1, a battery connector assembly 5 of a preferred embodiment according to the present invention has an elongate insulative housing 1 and a plurality of terminals 2. The housing 1 has a contacting wall 10, a rear wall (not labeled), a first sidewall 11, a second sidewall 12, a first inner wall 13 and a second inner wall 14. A first passageway 101, a second passageway 102 and a third passageway 103 are respectively defined by the contacting wall 10, the first and second sidewalls 11, 12, the first and second inner walls 13, 14 and the rear wall. A first notch 110 and a second notch 120 are respectively defined in the bottom edges of the first and second sidewalls 11, 12. A first opening 130 and a second opening 140 are respectively defined in bottom edges of the first and second inner walls 13, 14. A first clasp (not shown) is formed on the first inner wall 13 adjacent to the first opening 130 in the first passageway 101, and a second clasp 141 is formed on the second inner wall 14 adjacent to the second opening 140 in the third passageway 103. A slot (not labeled) is defined respectively between passageways 101, 102, 103 in the contacting wall 10 adjacent to the bottom edge of the contacting wall 10.

The terminals 2 are inserted molded with an elongate insulative insert part 20. The pitches between every two terminals 2 are equal. Each of the terminals 2 has a solder portion (not labeled), a S-shape spring portion 21, a contacting portion 23, a locating portion 24 extending at a free end of the contacting portion 23 and a connection portion 22 connecting the spring portion 21 and the contacting portion 23. The solder portions are molded in the insert part 20. Bottom surfaces 25 of the solder portions and a bottom surface 205 of the insert part 20 are on a same plane. A convexity 230 is located on the contacting portion 23 of each terminal 2. A first latch 201 and a second latch 203 are formed on the insert part 20 respectively between every two terminals 2. A first barb 202 and a second barb 204 are formed respectively on upper portions of the first and second latches 201, 203 and the first and second barbs 202, 204 are formed face-to-face. The thickness of the insert part 20 equals to the depth of the notches 110, 120 and the openings 130, 140. The width of the insert part 20 is a little narrower than the length of the notches 110, 120 and the openings 130, 140.

Figure 2:
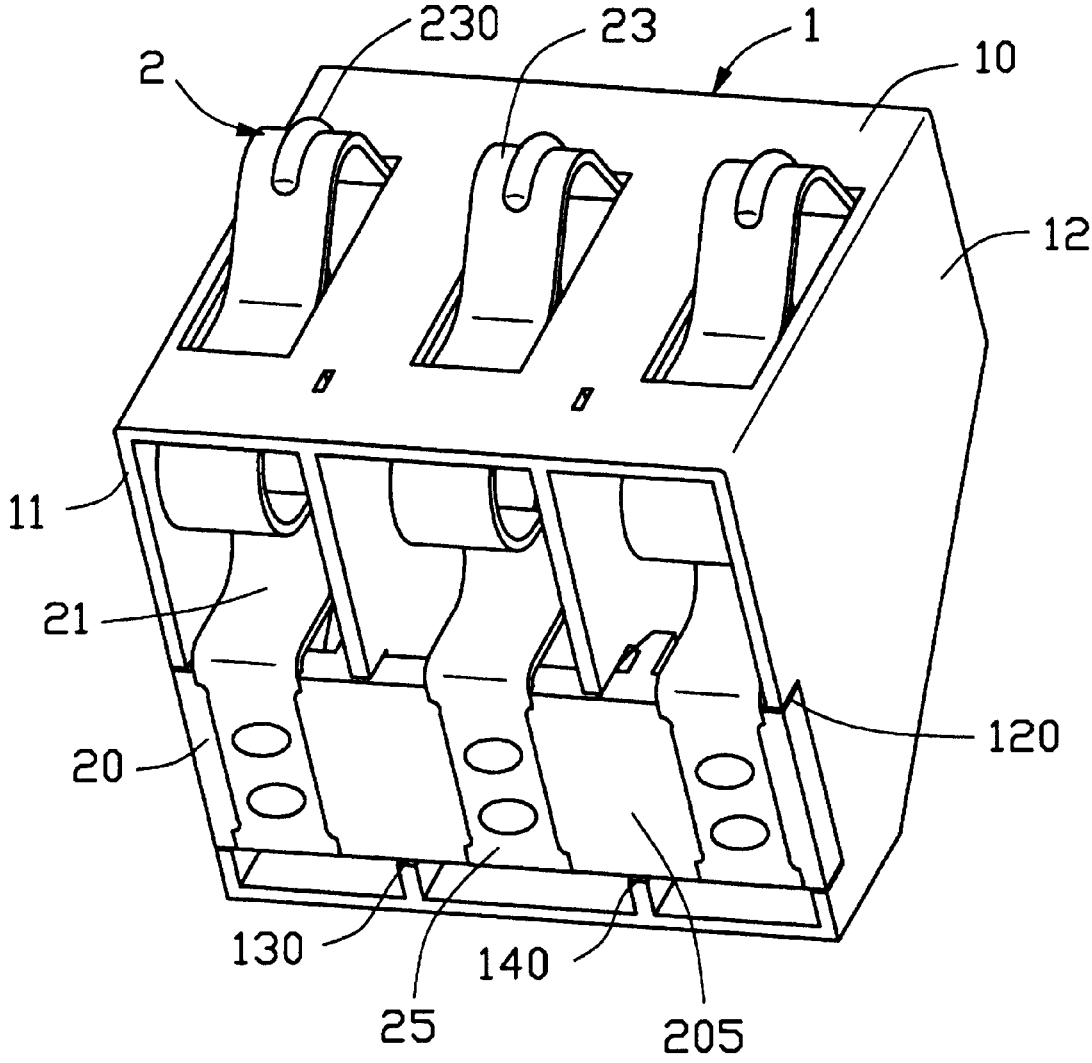
FIG. 2 is an assembled view of the battery connector assembly of FIG. 1.
Figure 3:
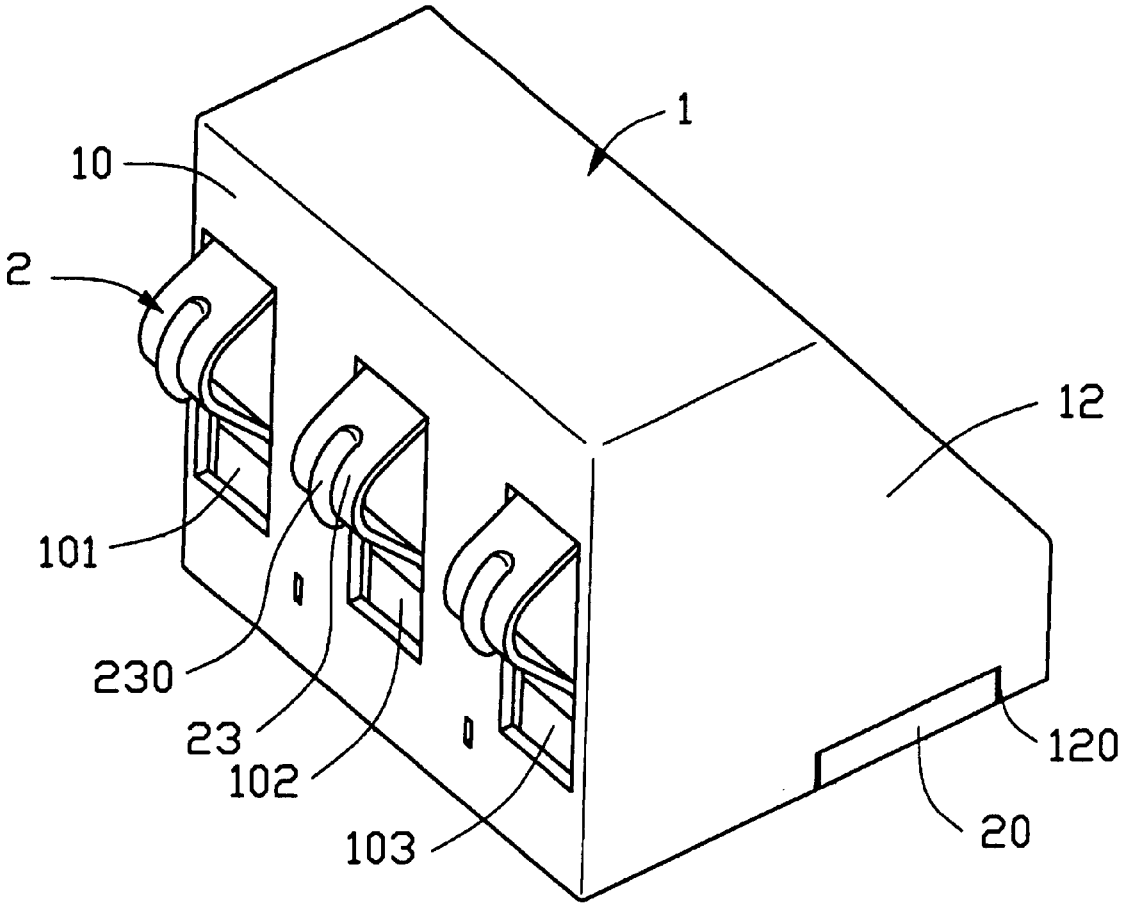
FIG. 3 is another perspective view of the battery connector assembly of FIG. 2.

Referring to FIGS. 2 and 3, in assembly, the terminals 2 are received respectively in the first passageway 101, the second passageway 102 and the third passageway 103. The contacting portion 23 projects beyond the contacting wall 10. The locating portion 24 abuts against the inner surface of the contacting wall 10. The insert part 20 is received in the first and second notches 110, 120 and the first and second openings 130, 140. The first and second latches 201, 203 are coupled respectively to the first and second openings 130, 140 of the first and second inner walls 13, 14, and the first and second barbs 202, 204 abut respectively against the first clasp and the second clasp 141 thereby securing the insert part 20 to the housing 1, thus a proper and firm engagement is formed between the terminals 2 and the housing 1. The bottom surface 205 of the insert part 20 and the bottom edges of the sidewalls 11, 12 and the inner walls 13, 14 are on a same plane after the terminals 2 are retained in the housing 1, thus a reliable connection is formed between the solder portion of the terminals 2 and a printed circuit board (PCB, not shown).

Figure 4:
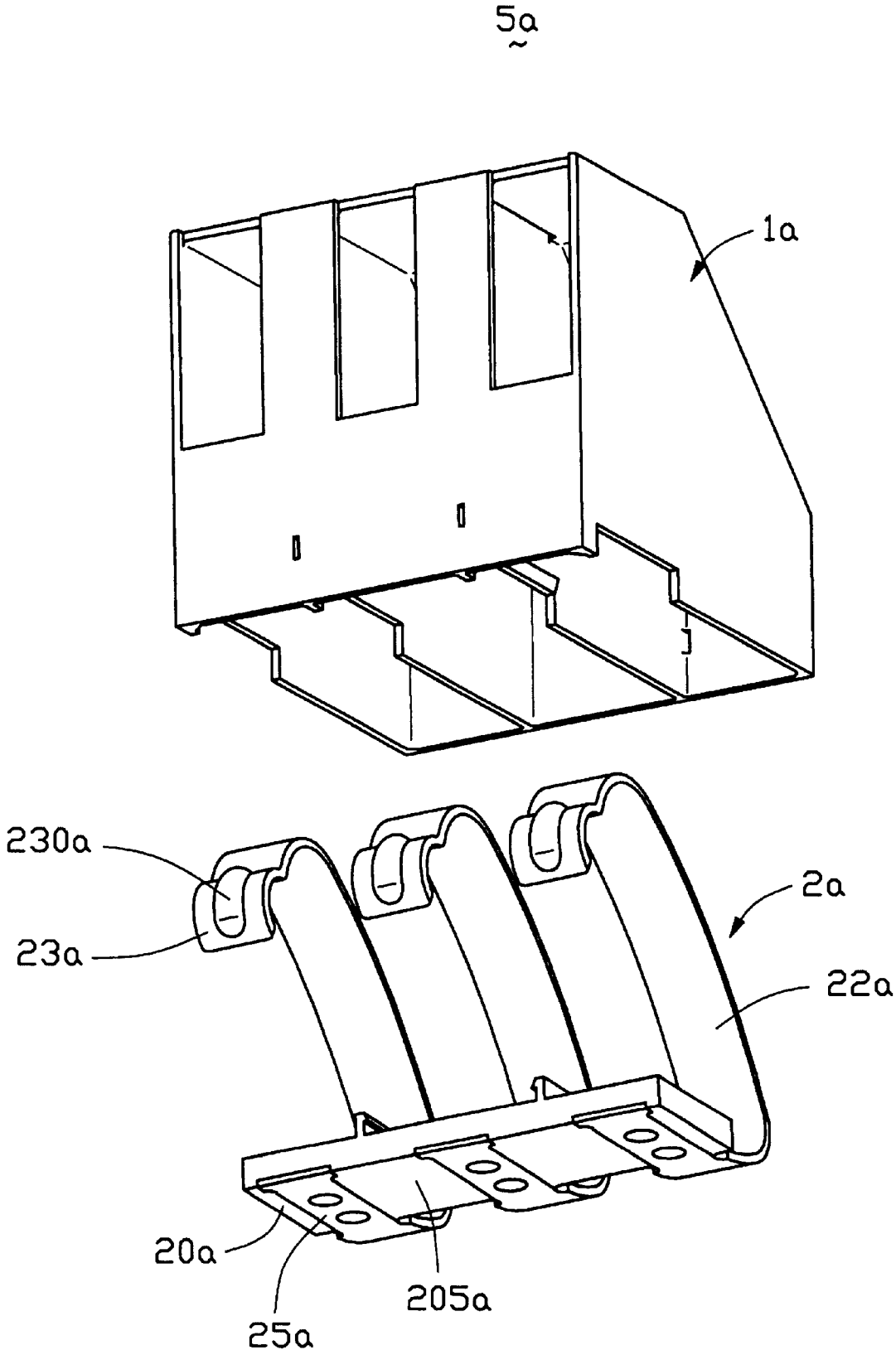
FIG. 4 is an exploded view of a battery connector assembly according to another embodiment of the present invention.
Figure 5:
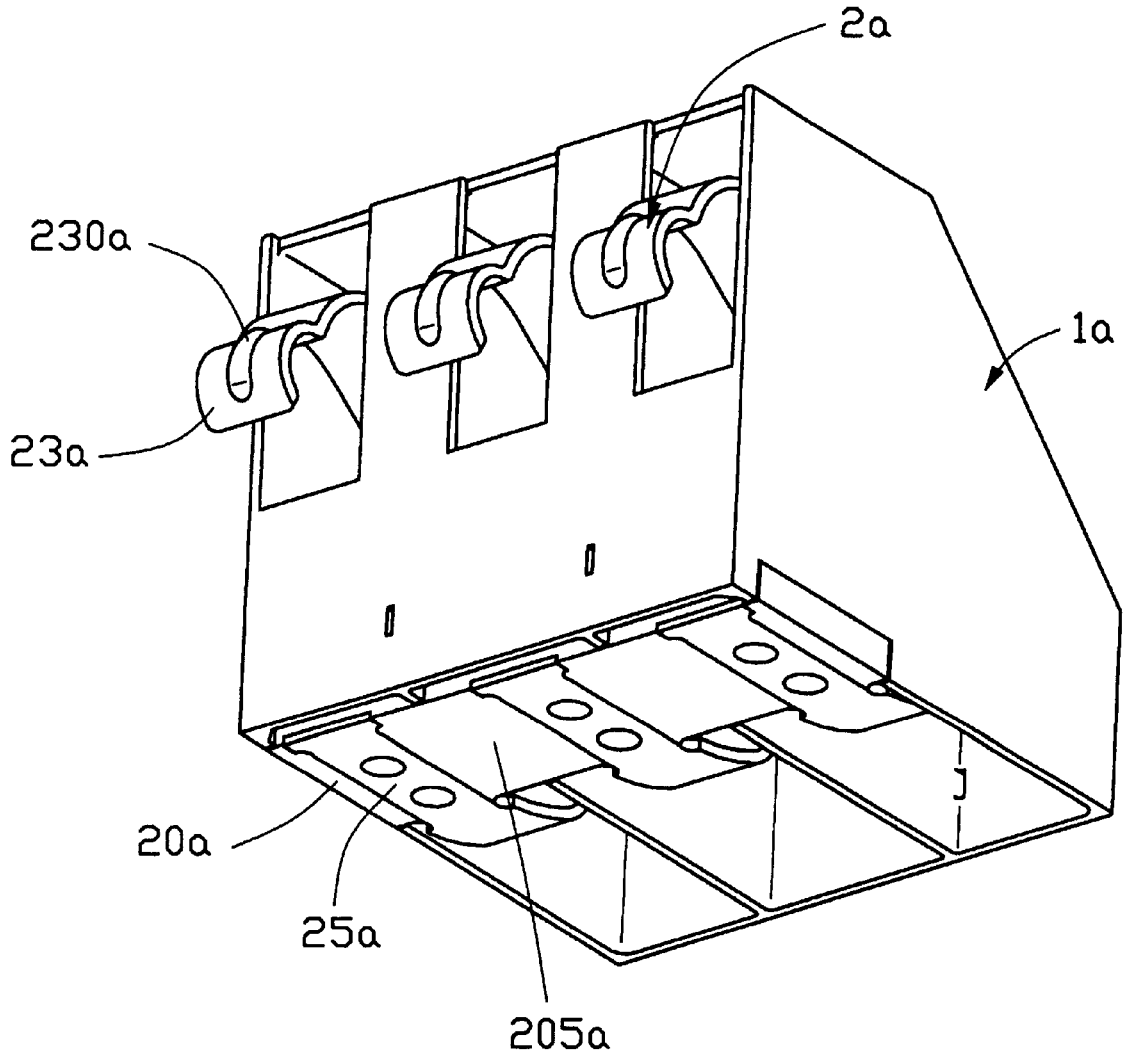
FIG. 5 is an assembled view of the battery connector assembly of FIG. 4.
Figure 6:
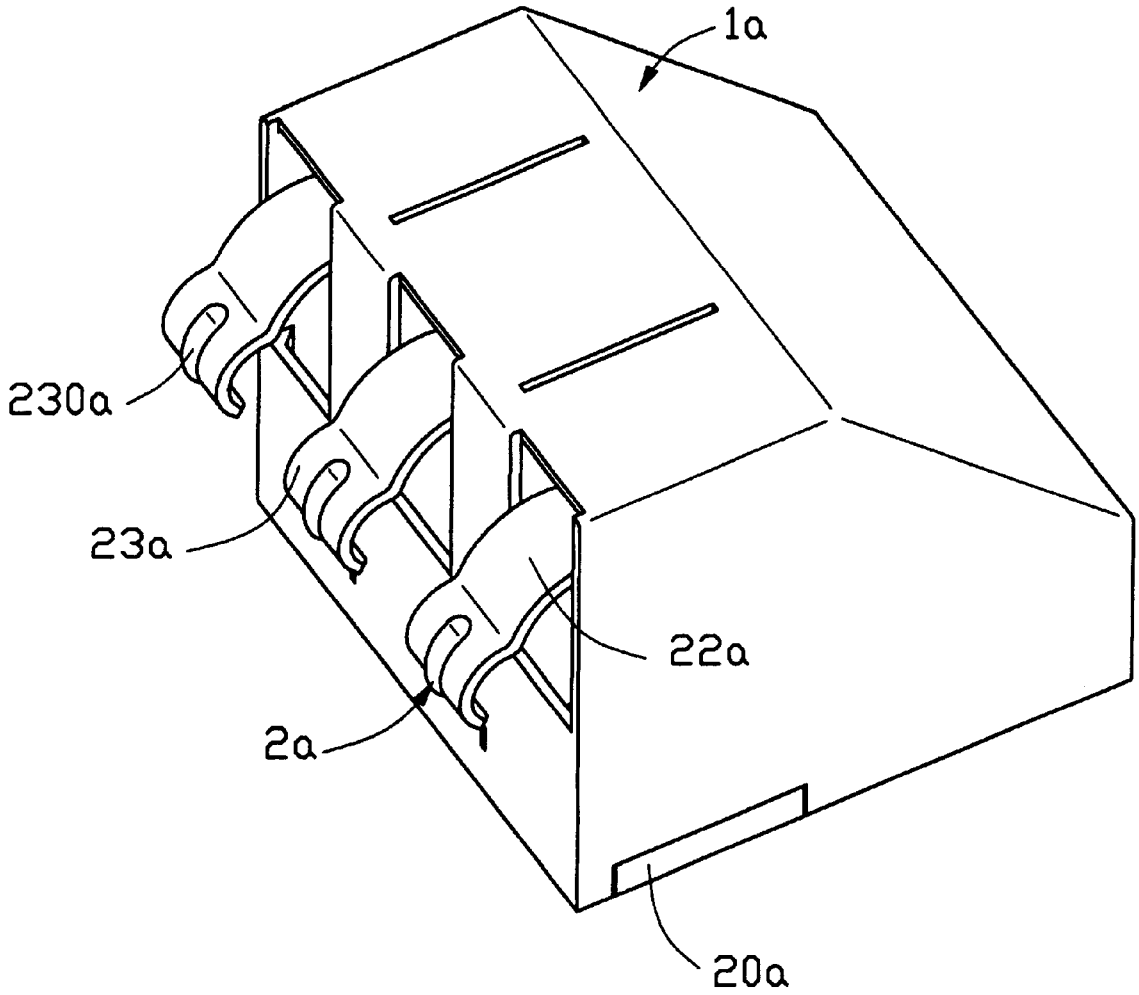
FIG. 6 is another perspective view of the battery connector assembly of FIG. 5.

FIGS. 4, 5 and 6 show another embodiment of the present invention. A battery connector assembly 5*a* of this embodiment has a housing 1*a* and a plurality of terminals 2*a*. The housing 1*a* of this embodiment is similar to the housing of the embodiment mentioned above. The terminals 2*a* are inserted molded with an insulative insert part 20*a*. Each of the terminals 2*a* has a solder portion (not labeled), a connection portion 22*a* and a contacting portion 23*a*. A convexity 230*a* is located on the contacting portion 23*a* of each terminal 2*a*. Bottom surfaces 25*a* of the solder portions of the terminals 2*a* and a bottom surface 205*a* of the insert part 20*a* are on a same plane. The remaining parts of the insert part 20*a* are identical to those of the embodiment mentioned above and thus a detail description is omitted herein.

The terminals 2, 2*a* of the battery connector assembly 5, 5*a* according to the present invention are received in the housing 1, 1*a* by cooperation of the first clasp (not shown), the second clasp 141, the first latch 201, 201*a,* the second latch 203, 203*a* and the barbs 202, 204, thus the terminals 2, 2*a* could be deposited in the housing 1, 1*a* steadily and a reliable connection could be formed between terminals 2, 2*a* of the battery connector assembly 5, 5*a* and corresponding terminals of a mobile phone (not shown).

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A battery connector assembly, comprising:

a housing having two sidewalls, an inner wall, a contacting wall and two passageways defined by the sidewalls, the inner wall and the contacting wall, the inner wall having a clasp;

two terminals received respectively in the passageways of the housing, each terminal having a solder portion, a connecting portion and a contacting portion;

an elongate insulative insert part having a latch engaged with the clasp of the housing, wherein the solder portions of the terminals are inserted molded with the insert part;

wherein an opening is defined in the inner wall of the housing adjacent to the clasp;

wherein a notch is defined in a lower portion of each sidewall;

wherein bottom surfaces of the solder portions and a bottom surface of the insert part are on a same plane;

wherein a thickness of the insert part is equal to individual depths of the notches and the opening, and a width of the insert part is narrower than individual length of the opening and the notches;

wherein and a barb is formed on an upper portion of the latch;

wherein and a middle of the contacting portion of the terminal is convex;

wherein the housing has and a second inner wall, and defines and a third passageway;

wherein and a second clasp is formed respectively on the third inner wall;

wherein and a second latch is formed on the insert part to engage with the second clasp.

* * * * *